US008747140B2

(12) United States Patent
Gassauer et al.

(10) Patent No.: US 8,747,140 B2
(45) Date of Patent: Jun. 10, 2014

(54) PLUG CONNECTOR SET AND PLATE FOR SAID PLUG CONNECTOR SET

(75) Inventors: Stephan Gassauer, Ilfeld (DE); Karsten Simon, Varrel (DE)

(73) Assignee: Wago Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 13/474,789

(22) Filed: May 18, 2012

(65) Prior Publication Data

US 2013/0040487 A1 Feb. 14, 2013

(30) Foreign Application Priority Data

May 20, 2011 (DE) ..... 10 2011 102 715

(51) Int. Cl.
*H01R 13/62* (2006.01)

(52) U.S. Cl.
USPC ..... 439/352

(58) Field of Classification Search
USPC ..... 439/352, 357, 358, 258; 385/53
See application file for complete search history.

(56) References Cited

U.S. PATENT DOCUMENTS

| | | | | |
|---|---|---|---|---|
| 5,564,939 | A * | 10/1996 | Maitani et al. | 439/352 |
| 6,250,943 | B1 | 6/2001 | Castle et al. | |
| 6,447,170 | B1 * | 9/2002 | Takahashi et al. | 385/53 |
| 7,163,413 | B2 * | 1/2007 | Murayama | 439/258 |
| 7,736,171 | B2 | 6/2010 | Reed et al. | |
| 8,475,197 | B2 * | 7/2013 | Zerebilov et al. | 439/352 |

FOREIGN PATENT DOCUMENTS

| | | |
|---|---|---|
| DE | 1465642 | 5/1939 |
| DE | 600 18 511 | 7/2005 |
| DE | 10 2007 056 252 | 11/2007 |
| EP | 1 014 499 | 6/2000 |
| JP | 7-22481 | 7/1995 |

OTHER PUBLICATIONS

WAGO Innovative Connections—PicoMax Steckverbinder (6 pages).

* cited by examiner

*Primary Examiner* — Alexander Gilman
(74) *Attorney, Agent, or Firm* — Renner, Otto, Boisselle & Sklar, LLP.

(57) ABSTRACT

A plug connector set has first and second plug connector parts, an unlocking part and a plate. The first plug connector has at least one first contact element and a latching lug. The second plug connector part has at least one second contact element. An unlocking part is used to displace the latching lug out of a locking position into the unlocking position or for latching to the latching lug and locking the first and second plug connector part to each other. A plate is adjacent to the latching lug and projects away from the first plug connector part.

11 Claims, 7 Drawing Sheets

PLUG CONNECTOR SET AND PLATE FOR SAID PLUG CONNECTOR SET

The invention relates to a plug connector set having a first plug connector part which has at least one first contact element and a latching lug, and having a second plug connector part which has at least one second contact element, having an unlocking part for displacing the latching lug out of a locking position into the unlocking position or for latching to the latching lug and locking the first and second plug connector part to each other in the fitted-together state, and having a plate on the second plug connector part which, in the fitted-together state of the first and second plug connector part, is adjacent to the latching lug and projects away from the first plug connector part, wherein the first and second plug connector part are compatible with each other and can be fitted together and in the fitted-together state provide an electrically conductive connection between first and second contact elements which are associated with each other.

The present invention additionally relates to a plate having a free latching end for latching to a second plug connector part of such a plug connector set.

Plug connector sets with plug connector parts that can be fitted together are sufficiently known in a great variety of embodiments.

DE 10 2007 056 252 A1 discloses a plug connector part with a locking pawl for locking the plug connector housing to the counter plug connector. A releasing element with a finger pointing in the direction of the locking pawl is mounted on the plug connector housing so as to be displaceable into a plug-in direction such that, when the releasing element is pushed forward in the direction of the locking pawl, a finger is guided under the locking pawl, which co-operates with the locking element in the plug connector housing, and, at the same time, for unlocking, the locking pawl is displaced by means of a flexible section of the locking pawl in a perpendicular manner with respect to the finger away from the locking element of the plug connector housing.

In addition, U.S. Pat. No. 7,736,171 B2 discloses a plug connector with a resilient locking lug which, for unlocking, can be raised by way of an unlocking lug, which is located below said locking lug and is guided so as to be displaceable on the plug connector housing.

DE 600 18 511 T2 discloses an unlocking mechanism for a plug connector set, which has a displacement element which is arranged at least partially inside the plug connection or the plug connector housing in the locked position of the two plug connector parts. By means of a tensile load in opposition to the plug-in direction, a wall of the plug connector housing is elastically deformed such that the latching position of a latching hook is lifted. By pulling further on the displacement element, the plug connector part, on which the displacement element is arranged, is also pulled out of the plug connection.

U.S. Pat. No. 5,564,939 A describes a plug connector set where a latching hook is arranged on the housing of a plug connector part. For unlocking, the latching hook can be lifted by way of a latching lug which is located under said latching hook and is guided so as to be displaceable on the plug connector housing.

In addition, the WAGO "picoMax plug connectors" brochure makes known a small revolution, catalogue picoMax 1.0 DE, 1/10 produced by the WAGO Kontakttechnik GmbH & Co. KG, arranging a lever arm adjoining a resilient latching lug of a pin bar, by way of which lever arm the latching lug can be displaced from a locking position into an unlocking position.

Proceeding from here, it is the object of the present invention to create an improved plug connector set by way of which simple and easily operated unlocking of a first and second plug connector part from each other and/or locking of a first and second plug connector part to each other is made possible in conjunction with a latching lug on the first plug connector part.

The object is achieved by the plug connector set of the aforementioned type in that the unlocking part is arranged on the plate so as to be at least partially movable in relation to the plate and has an unlocking section for abutment against the latching lug.

The object is additionally achieved by a plate having a free latching end for latching to a second plug connector part of such a plug connector set, by the plate having an unlocking part, which is arranged on the plate so as to be at least partially movable in relation to the plate and has an unlocking section which is developed for abutment against a latching lug of a first plug connector part, wherein the unlocking part is provided for displacing the locking lug out of the locking position into an unlocking position or for locking to the latching lug with securement of the latching lug in the locking position.

According to the teaching of the present invention, the unlocking part is consequently not arranged directly on a plug connector housing, but on a plate which is connected integrally to the plug connector housing or preferably is connected in a releasable manner to the plug connector housing. By at least one section of the unlocking part being arranged so as to be movable in relation to the plate, a latching lug can be locked and the latching lug can be secured in the locking position and, by way of a relative movement of the section, can be unlocked.

In a corresponding manner, it is also possible by way of the unlocking part to unlock the first and second plug connector part from each other when in the fitted-together state by the latching lug being displaced out of the locking position into an unlocking position by means of an unlocking section of the unlocking part.

The unlocking part is simple to handle as it is arranged on the plate which, with the first and second plug connector part in the fitted-together state, is adjacent to the latching lug and projects away from the first plug connector part.

This is advantageous inasmuch as when, in the case of the plug connector set, the first and second plug connector part are realized such that the first and second plug connector part are almost completely telescoped and the plug connector part located on the inside is only still able to be grasped and pulled out of the first plug connector part, which has the latching lug, by means of the protruding (grip) plate.

Consequently, it is advantageous when said preferably separate grip plate is utilized to carry and guide the unlocking part.

In the prior art, contrary to this, an unlocking lever is located directly on the housing of the plug connector part, such as, for example, on the latching lug of the first plug connector part.

In a particularly advantageous embodiment, the unlocking part is mounted on the plate so as to be displaceable as a whole in the plug-in direction, in which the first and second plug connector part can be fitted together. Said completely displaceable unlocking part then has an unlocking section which can be inserted between the plate and the latching lug in order to displace the preferably resilient latching lug from the locking position, which is spring-loaded in the direction of the second plug connector part, into the unlocking position, which is directed away from the second plug connector part.

In order to simplify the insertion of the unlocking section between the plate and the latching lug and to deflect the latching lug continuously with justifiable expenditure of force when guiding the unlocking part between the plate and the latching lug, it is advantageous when the unlocking section tapers toward the free end.

In another preferred embodiment, the unlocking part has a lever arm which, adjoining an unlocking section, which engages behind the latching lug in the fitted-together state, has a lever section. The lever arm is pivoted to the plate in the transition between the unlocking section and the lever section such that when force acts on the lever section in the direction of the plate, the opposite unlocking section is pivoted about the pivot point of the lever arm on the plate into the opposite direction. At the same time, the unlocking section exerts a force onto the latching lug by engaging behind the latching lug, for example, in order to guide the latching lug in the fitted-together state away from the second plug connector part into the unlocking position.

The advantage of the arrangement of the unlocking part on the grip plate, in this case, is that, when the unlocking part is activated by hand, the grip plate is grasped at the same time and the second plug connector part can be pulled out of the first plug connector part once the latching lug is guided out of the locking position.

In another embodiment, the unlocking part has a resilient pressure plate with an unlocking section, which points in the direction of the latching lug and is guided so as to be movable on the plate in the plug-in direction. In addition, the pressure plate has a pressure section which connects to the unlocking section and is connected to the plate at its end region opposite the unlocking section and consequently is secured in relation to the plate. The pressure section has a bulge in relation to the plate, adjacent to the connection between the end region of the pressure section and the plate, said bulge, when it is pressed in, bringing about a displacement of the unlocking section in the plug-in direction behind the latching lug for unlocking the latching lug.

Consequently, the effect of activating the pressure plate by exerting pressure between the plate and the bulge of the pressure plate is that the adjoining unlocking section, which is guided on the plate in the plug-in direction, is guided between the plate and/or the second plug connector part and the latching lug in order, in this way, to displace the latching lug away from the second plug connector part out of the locking position into the unlocking position.

By applying a tensile force onto the (grip) plate, the second plug connector part can then be pulled out of the first plug connector part.

In another variant, the unlocking part is utilized primarily for locking to the latching lug. Unlocking is effected, once again, by applying force onto the unlocking part in relation to the plate such that the locking of the unlocking part to the latching lug is lifted. In the case of this variant, the second plug connector part itself is not locked to the latching lug.

The unlocking part, in the case of this embodiment, has a lever arm which, adjoining an unlocking or locking section which engages over the latching lug in the fitted-together state, has a lever section and is pivoted to the plate in the transition between the unlocking or locking section and the lever arm. The lever arm has a spring section which extends between the lever section and the plate and exerts a spring tension between the plate and the lever arm and, in the fitted-together state, presses the unlocking or locking section against the latching lug.

The unlocking section or locking section preferably has latching means which are adapted to corresponding latching means of the latching lug for latching to the latching lug.

In the case of the described embodiments, in particular in conjunction with a resilient latching lug, it is advantageous when the latching of the first and second plug connector part is effected by means of latching elements on the latching lug and the second plug connector part. The latching lug, in this case, has at least one first latching element and the second plug connector part has at least one second latching element which, for latching the second plug connector part to the first plug connector part, is adapted to the respectively associated first latching element of the latching lug.

The latching is then lifted by displacing the resilient latching lug or, however, by applying a tensile force onto the second plug connector part in relation to the first plug connector part. The lifting of the latching by applying a tensile force onto the second plug connector part in relation to the first plug connector part presupposes though that the latching elements do not have any sharp latching stop members.

The invention is explained below by way of exemplary embodiments with the attached drawings, in which, in detail:

Figure 1:
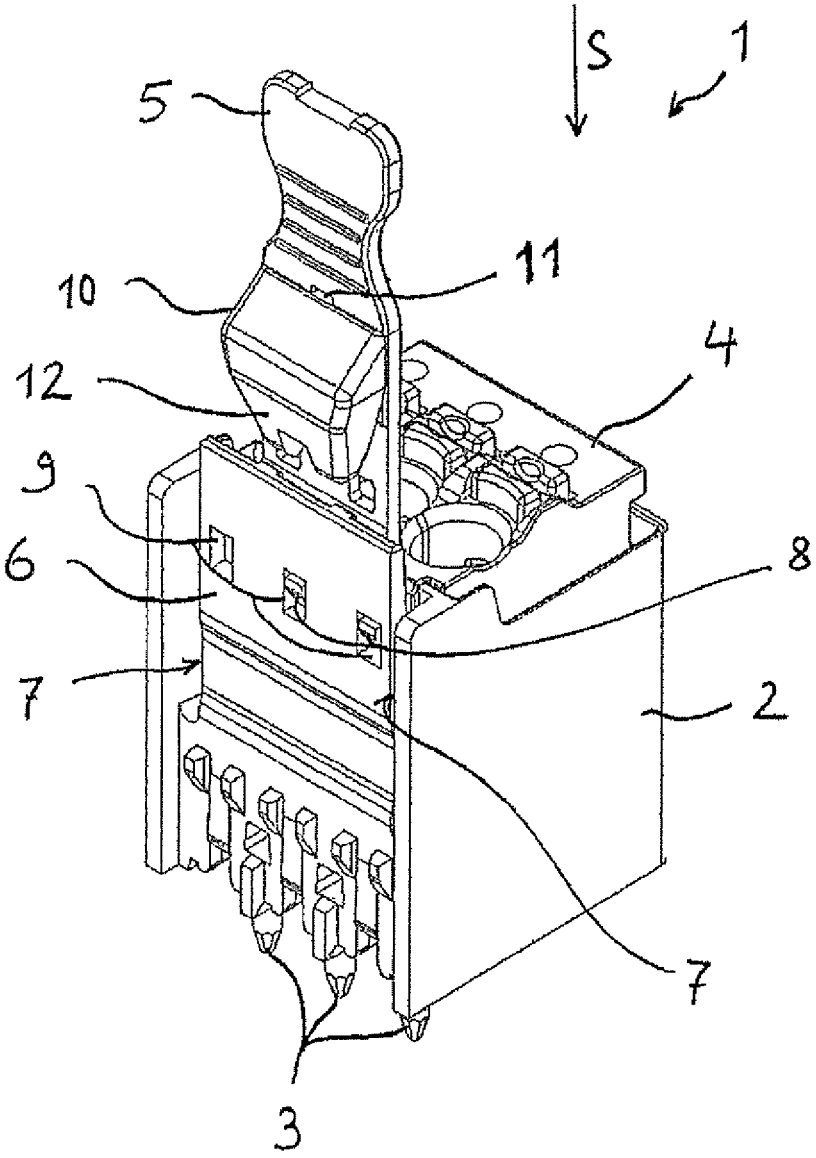
FIG. 1 shows a perspective view of a plug connector set having a first embodiment of an unlocking part.

A perspective view of a plug connector set 1 can be seen in FIG. 1, said plug connector set having a first plug connector part 2 with first contact elements 3 in the form of pin contacts as well as a second plug connector part 4 with second contact elements (not visible) which correspond to the first contact elements 3. It can be seen that the second plug connector part 4 is pushed in the plug-in direction S into the first plug connector part and is located in the fitted-together state.

A separate (grip) plate 5 is releasably connected to the second plug connector part 4 preferably by means of latching such that the second plug connector part 4 can be pulled out of the first plug connector part 2 in opposition to the plug-in direction S by grasping the plate 5. In addition, a further use of the plate 5 can be to secure electric leads inserted into the second plug connector part 4 on the plate 5 by means of cable binders.

In addition, it is clear that, on its back surface, the first plug connector part 2 has a latching lug 6 of insulating material which is produced in one piece with the housing of the first plug connector part 2. By the side edges of the latching lug 6 not being connected to the housing wall of the first plug connector part 2, but there being a space 7 present, the latching lug 6 can be displaced from the shown locking position away from the second plug connector part 4 to the rear into an unlocking position.

In the locking position shown, latching projections as latching elements 8, which are integrally molded on the second plug connector part 4 or, where applicable, on the plate 5 and project outward from the respective surface, engage in latching openings as latching elements 9 on the latching lug 6. The latching elements of the second plug connector part 4 or of the associated plate 5 and the latching elements 9 of the latching lug 6, in this case, are matched to each other such that, in the fitted-together state of the first and second plug connector part 2, 4 shown, the second plug connector part 4 is latched to the latching lug 6 such that the second plug connector part 4 cannot easily be pulled out of the first plug connector part 2.

In order then to be able to pull the second plug connector part 4 out of the first plug connector part 2 and consequently to break the plug connection, the latching lug 6 has to be displaced away from the second plug connector part 4 to the rear into an unlocking position. Provided for this purpose is an unlocking part 10 which is guided on the plate 5 so as to be displaceable in the plug-in direction S in the direction of the latching lug 6. To this end, the plate 5 has a guide slot 11 which extends in the plug-in direction S and into which a guide projection of the unlocking part 10 projects.

In addition, it is clear that on its free end facing the latching lug 6, the unlocking part 10 has an unlocking section 12, which tapers toward the free end, i.e. reduces toward the free end. In this way, the unlocking section 12 of the unlocking part 10 can be guided between the plate 5 and the latching lug 6 when the unlocking part 10 is pushed downward in the plug-in direction S in the direction of the first plug connector part 2. When inserting the unlocking section 12 between the plate 5 or the second plug connector part 4 and the locking lug 6, the locking lug 6, as a result of the increasing thickness of the unlocking section, is then displaced further and further from the locking position (as shown) into the unlocking position, i.e. away from the second plug connector part 4.

Figure 2:
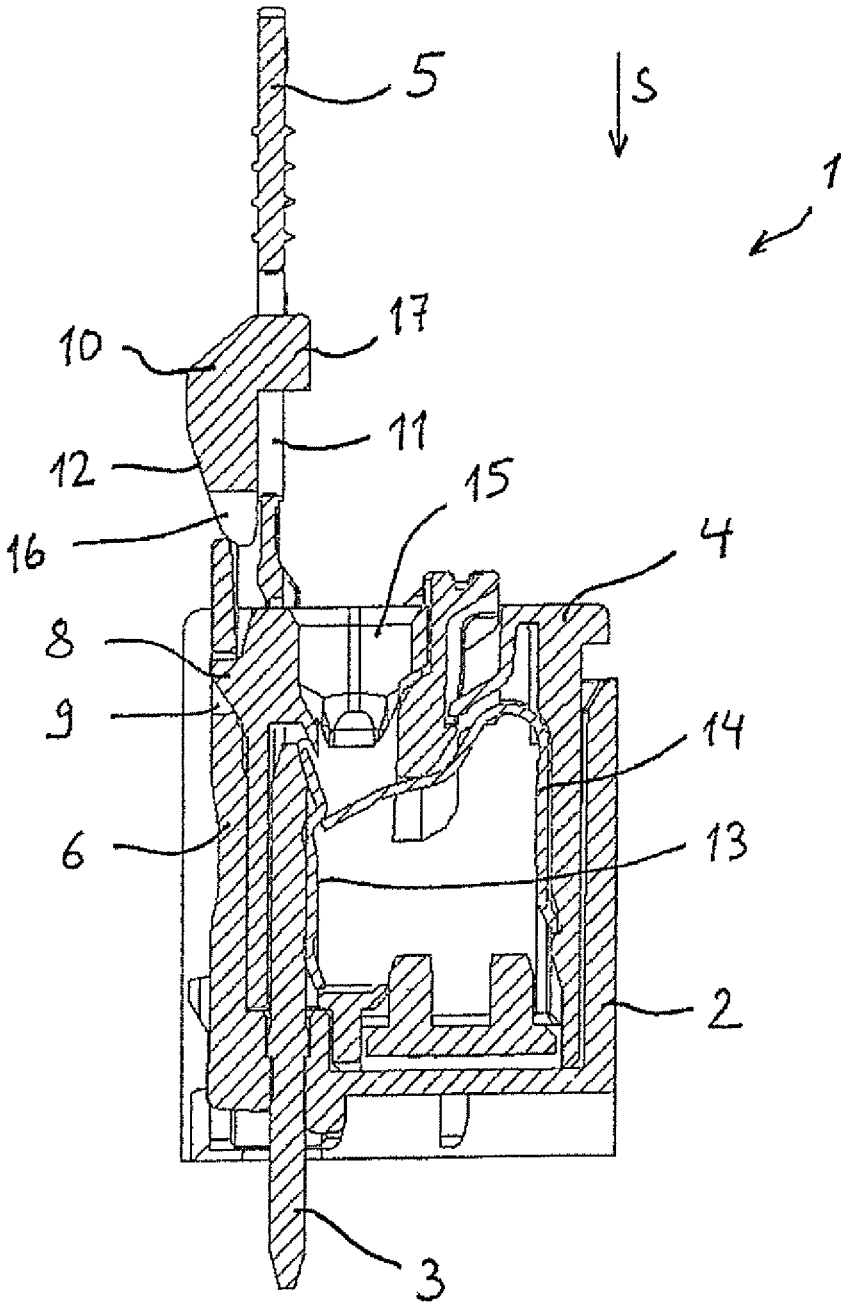
FIG. 2 shows a sectional view from the side of the plug connector set from FIG. 1.

A sectional view from the side of the plug connector set 1 from FIG. 1 can be seen in FIG. 2. In this case, it is also possible to see the second contact element 13, which is integrated in the interior of the insulating material housing of the second plug connector part 4 and serves with a contact spring 14 for connecting an electrical conductor (not shown), inserted in a conductor insertion opening 15 into the second plug connector part 4. Consequently, in the fitted-together state, an electrically conductive contact is created between such an electrical conductor, clamped against the second contact element by means of the contact spring 14, and the first contact element 3.

It is also clear from FIG. 2 that the tapering free end of the unlocking section 12 slides into the space between the plate 5 and the latching lug 6 or subsequently into the space between the second plug connector part 4 and the latching lug 6 and, in this case, pivots the latching lug 6 from the shown locking state away from the second plug connector part 4 into the unlocking state. So that the latching lug 6 is able to carry out this pivoting movement, it is produced in a resilient manner from insulating plastics material integrally with the housing of the first plug connector part 2 which is also produced from insulating plastics material.

In addition, it is clear that in the unlocking section 12 toward the free end there is a groove 16 which makes it possible for the latching element 8 (latching projection) on the second plug connector part 4 to move into the unlocking section 12. It is ensured in this way that the unlocking part 10 is able to be moved far enough downward in the plug-in direction S in the direction of the bottom of the first plug connector part 2.

In addition, it is clear that a preferably rectangular guide slot 11, which extends in the plug-in direction S, is provided in the plate 5, a guide projection 17 of the unlocking part 10 being inserted into said guide slot. The unlocking part 10 is secured on the plate 5 so as to be displaceable by means of the guide projection 17 by the guide projection 17 being widened at the free end and protruding beyond the side edges of the guide slot 11.

Figure 3:
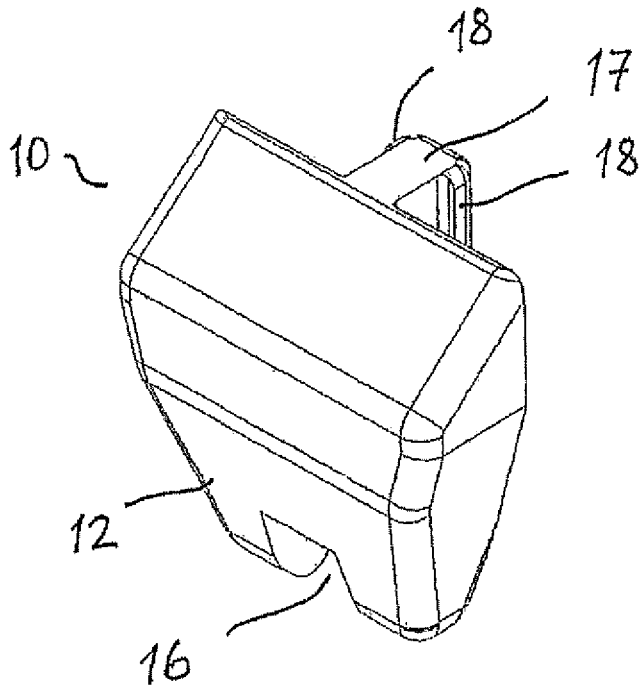
FIG. 3 shows a perspective representation of a first embodiment of an unlocking part for the plug connector set from FIGS. 1 and 2.

A perspective view of a first embodiment of the unlocking part 10 can be seen in FIG. 3. It is clear that in the region of the free end of the guide projection 17, which is realized as a web, lateral retaining webs 18 protrude such that the plate 5 is accommodated between the retaining webs 18 and the main body of the unlocking part 10 and the unlocking part 10 is consequently secured on the plate 5 so as to be displaceable.

In addition, it can be seen that the free bottom end of the unlocking section 12 has a groove 16 or opening into which the latching elements 8 of the second plug connector part 4 are able to move.

Figure 4:
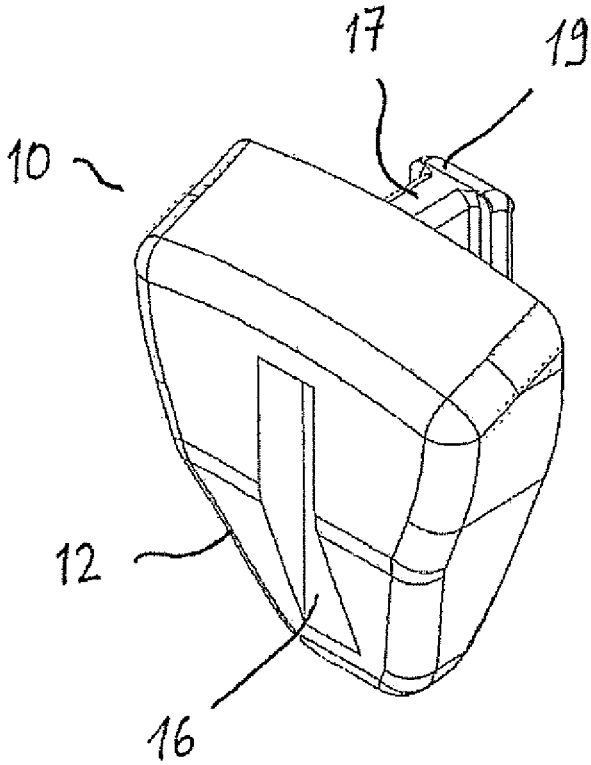
FIG. 4 shows a perspective representation of a second embodiment of an unlocking part for the plug connector set from FIGS. 1 and 2.

A second embodiment of the unlocking part 10 can be seen in FIG. 4. In this connection, the guide projection 17 is realized, once again, as a protruding web which extends in the plug-in direction S. The free end of the web is closed off by way of a safety plate 19, the lateral ends of which project from the web (guide projection 17) in order to accommodate the plate 5 between the main body of the unlocking part 10 and the closure plate 19.

In addition, it is clear that, in the case of said exemplary embodiment, the groove 16 in the unlocking section 12 is not completely continuous, but is realized rather as an indentation on the surface of the reducing unlocking section 12 and of the main section of the unlocking part 10 connected thereto. This embodiment allows the unlocking part 10 to slide in between the plate 5 and the latching lug 6 in an improved manner when webs protrude on the top free end of the latching lug 6 on the side which faces the plate 5, said webs then being able to move into the groove 16.

Figure 5:
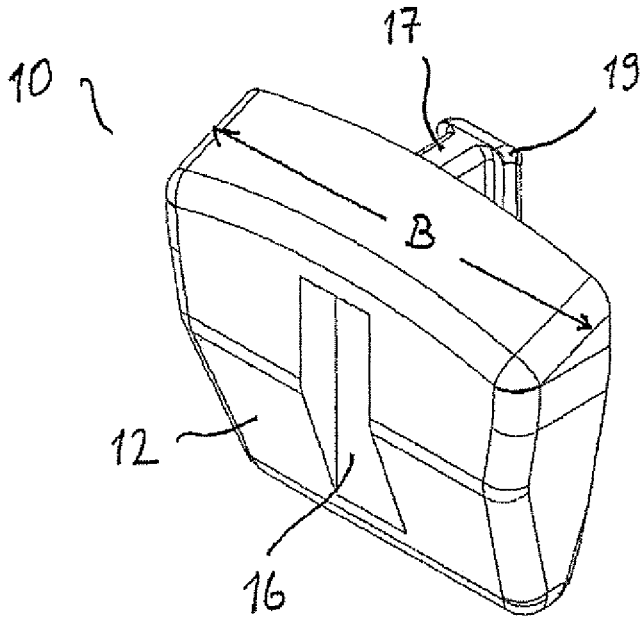
FIG. 5 shows a perspective representation of a third embodiment of an unlocking part for the plug connector set from FIGS. 1 and 2.

An embodiment of an unlocking part 10 which is comparable with the embodiment in FIG. 4 can be seen in FIG. 5. In the case of the embodiment according to FIG. 5, the area of the unlocking part 10 is rectangular such that the width B of the top, thicker main section of the unlocking part 10 corresponds to the width of the free end of the unlocking section 12.

In the embodiment according to FIG. 4, the unlocking section 12 is developed with decreasing width running not only in the direction of the thickness but also in the direction of the width.

Figure 6:
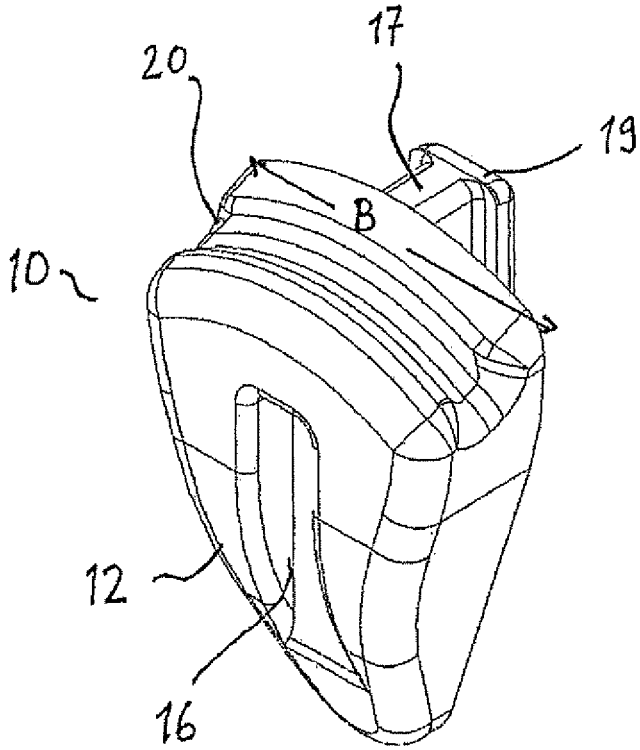
FIG. 6 shows a perspective representation of a fourth embodiment of an unlocking part for the plug connector set from FIGS. 1 and 2.

A further embodiment of an unlocking part 10 can be seen in FIG. 6, where the unlocking section 12 does not taper in a uniform manner as in FIGS. 3 to 5, but runs in a curved manner and the unlocking section also tapers in the direction of the width B toward the free end.

In addition, it is clear that a recessed grip 20 is realized on the top surface of the unlocking part 10 on the main section, said recessed grip making possible secure activation with reduced risk of slipping off the unlocking part 10. In addition, it is clear that the top surface of the main section of the unlocking part 10 is convex.

Figure 7:
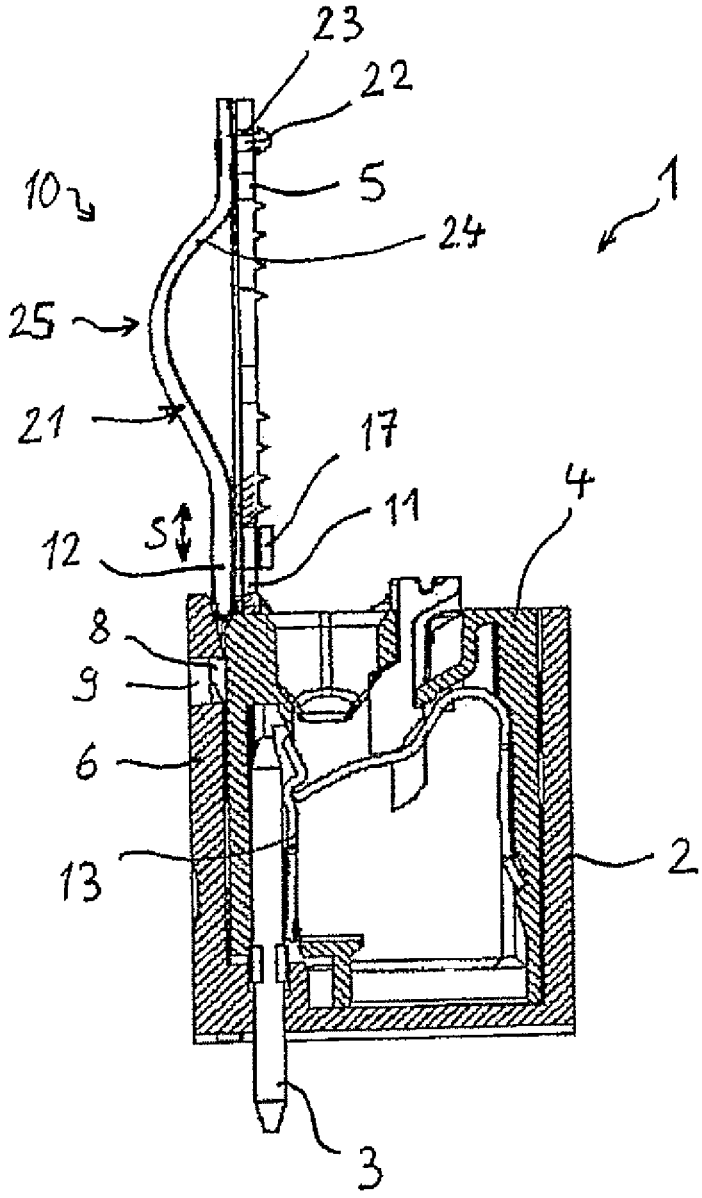
FIG. 7 shows a sectional view from the side through a plug connector set having a second embodiment of an unlocking part.

A further embodiment of a plug connector set 1 can be seen in FIG. 7, where the first and second plug connector part 2, 4 are comparable with the embodiment according to FIGS. 1 and 2 such that reference can be made to what was said there.

In the case of said embodiment, the unlocking part 10 has a resilient pressure plate 21 which fixes to the plate 5 at its upper free end e.g. by way of a latching pin 22. The latching pin 22, in this case, is inserted into a bore 23 in the plate 5 and is latched in the bore 23 at the free end by means of its protruding head.

A guide slot 11 is provided in the plate 5 in the bottom region adjoining the second plug connector part 4, into which guide slot a guide projection 17 engages, in a manner comparable with the unlocking part 10 described previously, in order to mount the unlocking section 12 of the pressure plate 21 on the plate 5 so as to be displaceable in the plug-in direction S. In this way, the unlocking section 12 can be guided upward or downward (see arrow) in the plug-in direction S in the guide slot 11.

By means of the securing at the top end on the plate 5 and the guiding at the bottom end, the pressure plate has a bulge 24 in the pressure section 25 as a result of a surplus of material. By exerting pressure onto the pressure section 25, i.e. by grasping the plate on the side remote from the pressure plate 21 and grasping the bulge 25, the bulge 25 is pressed in the direction of the plate 5 and, at the same time, the unlocking section 12 is displaced downward in the direction of the first and second plug connector part 2, 4. As a result, the unlocking section 12 passes into the space between the second plug connector part 4 and the latching lug 6 in order to displace the latching lug 6 out of the shown locking position away from the second plug connector part 4 into the unlocking position and consequently to break the latching connection between the second plug connector part 4 and the latching lug 6. The second plug connector part 4 can then subsequently be pulled upward out of the first plug connector part 2 by pulling on the plate 5.

Figure 8:
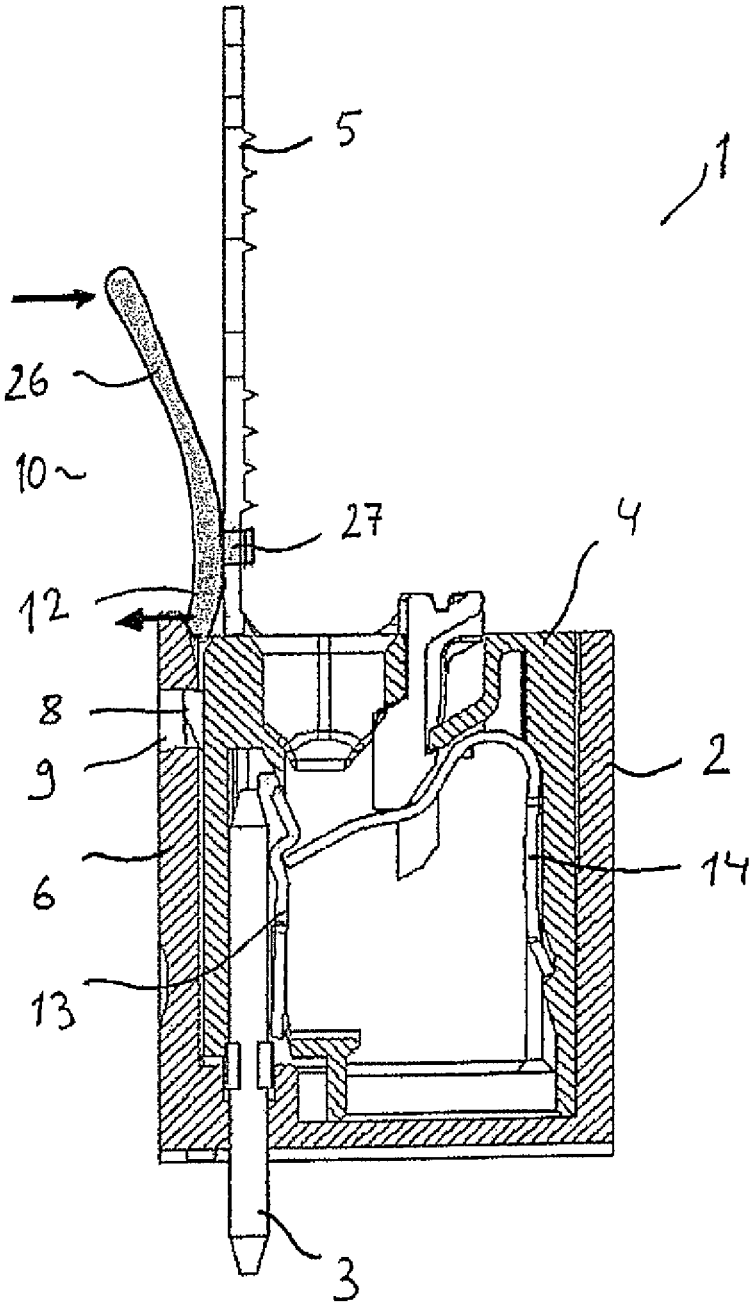
FIG. 8 shows a sectional view from the side through a plug connector set having a third embodiment of an unlocking part.

A further embodiment of a plug connector set 1 can be seen in FIG. 8, where the unlocking part 10 is realized as a lever arm with a lever section 26 and an unlocking section 12 connecting thereto. The lever section 26, in this case, projects away from the plate 5 and is curved outward in a corresponding manner, whilst the unlocking section 12 is also curved away from the plate 5 in the direction of the latching lug 6. In this way, the unlocking section 12 engages behind the top free end of the latching lug 6 when the plate 5 is connected to the second plug connector part 4 and the first and second plug connector part 2, 4 are situated in the fitted-together state (as shown in FIG. 8).

It is clear that the unlocking part is pivoted on the plate 5 by way of a fastening element 27 in the transition between the unlocking section 12 and the lever section 26. This means that, when a force is exerted onto the lever section 26 in the direction of the plate 5, the lever arm is pivoted about the pivoting point on the fastening part 27 and the unlocking section 12 is displaced in the opposite direction in order to pivot the latching lug 6 away from the second plug connector part 4 and consequently to break the latching connection between the second plug connector part 4 and the latching lug 6.

Figure 9:
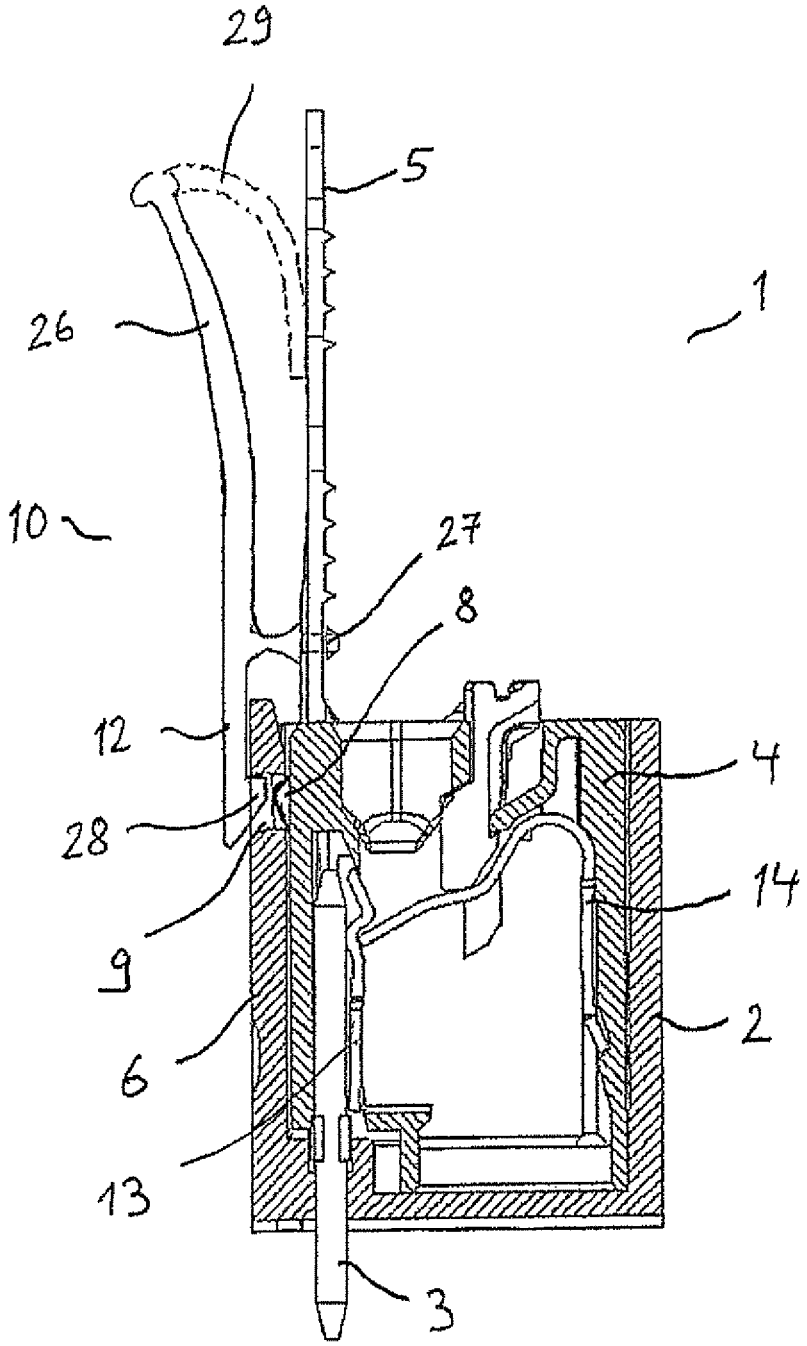
FIG. 9 shows a sectional view from the side through a plug connector set having a fourth embodiment of an unlocking part.

Another embodiment of a plug connector set 1 can be seen in FIG. 9, where the first and second plug connector part 2, 4 are once again developed in a manner comparable with the previously described embodiments.

In the case of said embodiment, however, no sharp-edged latching is provided between the second plug connector part 4 and the latching lug 6. The latching means 8 of the second plug connector part 4 is not absolutely necessary and is only shown as an optional latching element 8. The top surface of the latching element 8 (latching projection) is beveled such that the second plug connector part 4, without separate displacement of the latching lug 6, can be pulled out of the first plug connector part 2 out of the shown locking position into the unlocking position. When the second plug connector part 4 is pulled out, for example by means of the plate 5, which projects upward from the second plug connector part 4, the latching lug 6 is automatically displaced by the protruding latching element 8.

In order now to ensure secure latching of the second plug connector part 4 in the first plug connector part 2 in the shown fitted-together state, the unlocking part 10 on the plate 5 is also realized as a locking part. Once again, the unlocking part 10 is realized in a manner comparable with the embodiment shown in FIG. 8 as a lever arm with a lever section 26 and an unlocking section 12 which engages over the latching lug 6. The lever arm is once again fixed on the plate 5 so as to be pivotable by way of a fastening element 27 in the transition between the unlocking section 12 and the lever arm 26. The fastening element 27, in this connection, can be realized as in the embodiment according to FIG. 7 as a latching pin which is inserted into a latching opening on the plate S and is secured there by means of a widened head.

It is clear that the free end of the unlocking section 12 has a protruding sharp-edged latching projection 28 which moves into the latching opening 9 of the latching lug 6 and, in this case, points in the direction of the second plug connector part 4. The second plug connector part 4, in this case, is latched to the first plug connector part 2 from the side opposite the second plug connector part 4 on the latching lug 6.

In order to ensure that the unlocking section 12 with the latching projection 28 is resilient against the latching lug 6 and remains there even in the fitted-together state, a spring section 29 is provided as an option at the free end of the lever section 26, said spring section extending from the lever section 26 in the direction of the plate 5 and abutting against the plate 5. The spring section 29 can be produced of plastics material in an integral manner with the unlocking part 10 and its spring action can develop through the resilience of the plastics material and the curved shape.

However, the spring tension of the pivoting of the unlocking part 10 on the plate 5 is possibly already sufficient to ensure reliable latching. The springing back can then be ensured, where applicable, by the resilience of the lever arm 26 and of the unlocking section 12.

The invention claimed is:

1. A plug connector set, comprising:

a first plug connector part including at least one first contact element and a latching lug;

a second plug connector part including at least one second contact element;

an unlocking part for displacing the latching lug out of a locking position into an unlocking position or for latching to the latching lug and locking the first and second plug connector part to each other in a fitted-together state; and a plate arranged on the second plug connector part which, in the fitted-together state of the first and second plug connector part, is adjacent to the latching lug and projects away from the first plug connector part, wherein the first and second plug connector part are compatible with each other and can be fitted together and in the fitted-together state provide an electrically conductive connection between the first and second contact elements which are associated with each other, and wherein the unlocking part is arranged on the plate so as to be at least partially movable in relation to the plate and has an unlocking section for abutment against the latching lug, wherein when the first and second plug connector part are in the fitted-together state the unlocking section is insertable into an interface between the first and second plug connector part and retractable outside the interface.

2. The plug connector set according to claim 1, wherein the unlocking part is mounted on the plate so as to be displaceable as a whole in a plug-in direction, in which the first and second plug connector part can be fitted together, and the unlocking section can be inserted between the plate and the latching lug.

3. The plug connector set according to claim 2, wherein the unlocking section tapers toward a distal end of the unlocking section.

4. The plug connector set according to claim 1, wherein the unlocking part has a lever arm, which, adjoining an unlocking section, that engages behind the latching lug in the fitted-together state, has a lever section and is pivoted to the plate in the transition between the unlocking section and the lever section.

5. The plug connector set according to claim 1, wherein the unlocking part has a resilient pressure plate with an unlocking section, which points in the direction of the latching lug and is guided on the plate so as to be movable in the plug-in direction, and with a pressure section which connects to the unlocking section, wherein the pressure section is connected to the plate at its end region opposite the unlocking section and is secured in relation to the plate, and wherein the pressure section has a bulge in relation to the plate, said bulge, when it is pressed in, bringing about a displacement of the unlocking section in the plug-in direction behind the latching lug for unlocking the latching lug.

6. The plug connector set according to claim 1, wherein the unlocking part has a lever arm which, adjoining an unlocking section that engages over the latching lug in the fitted-together state, has a lever section and is pivoted to the plate in the transition between the unlocking section and the lever arm, and in that the lever arm has a spring section which extends between the lever section and the plate and exerts a spring tension between the plate and the lever arm and, in the fitted-together state, presses the unlocking section against the latching lug.

7. The plug connector set according to claim 6, wherein the unlocking section has latching device adapted to a corresponding latching device of the latching lug for latching to the latching lug.

8. The plug connector set according to claim 1, wherein the latching lug has at least one first latching element and the second plug connector part has at least one second latching element, which, for latching the second plug connector part to the first plug connector part, is adapted to a respectively associated first latching element of the latching lug.

9. A plug connector set, comprising:

a first plug connector part which has at least one first contact element and a latching lug;

a second plug connector part which has at least one second contact element;

an unlocking part for displacing the latching lug out of a locking position into an unlocking position or for latching to the latching lug and locking the first and second plug connector part to each other in a fitted-together state; and a plate on the second plug connector part which, in the fitted-together state of the first and second plug connector part, is adjacent to the latching lug and projects away from the first plug connector part, wherein the first and second plug connector part are compatible with each other and can be fitted together and in the fitted-together state to provide an electrically conductive connection between the first and second contact elements which are associated with each other, and wherein the unlocking part is arranged on the plate so as to be at least partially movable in relation to the plate and has an unlocking section for abutment against the latching lug, wherein the plate is a separate plate which can be releasably connected to the second plug connector part.

10. A plate for interfacing with a first plug connector part which includes at least one first contact element and a latching lug, and a second plug connector part which has at least one second contact element, the plate having a free latching end for latching to the second plug connector part wherein the plate has an unlocking part, which is arranged on the plate so as to be at least partially movable in relation to the plate and has an unlocking section which is developed for abutment against the latching lug, wherein the unlocking part is provided for displacing the latching lug out of the locking position into the unlocking position or for locking to the latching lug with securement of the latching lug in the locking position, wherein when the first and second plug connector part are in the fitted-together state the unlocking section is insertable into an interface between the first and second plug connector part and retractable outside the interface.

11. The plate according to claim 10, wherein the unlocking part is mounted on the plate so as to be displaceable as a whole in the plug-in direction, in which the first and second plug connector part can be fitted together, and the unlocking section can be inserted between the plate and the latching lug.

* * * * *